United States Patent [19]

Hofmann

[11] 4,406,588

[45] Sep. 27, 1983

[54] COMPRESSOR SUCTION REGULATOR

[76] Inventor: Rudolf Hofmann, c/o Isartaler Schraubenkompressoren GmbH, Wallensteinstrasse 20, 8192 Geretsried 2, Fed. Rep. of Germany

[21] Appl. No.: 203,396

[22] Filed: Nov. 3, 1980

[51] Int. Cl.[3] ..... F04B 49/08

[52] U.S. Cl. ..... 417/281; 417/295; 417/309

[58] Field of Search ..... 417/295, 281, 309

[56] References Cited

U.S. PATENT DOCUMENTS

| | | | |
|---|---|---|---|
| 1,948,907 | 2/1934 | Egli | 417/295 |
| 2,234,488 | 3/1941 | Dick | 417/295 X |
| 2,661,893 | 12/1953 | Valley | 417/295 X |
| 3,788,776 | 1/1974 | Post et al. | 417/295 |
| 4,171,188 | 10/1979 | Anderson et al. | 417/295 X |
| 4,237,926 | 12/1980 | Walker | 417/295 X |

*Primary Examiner*—Richard E. Gluck

*Attorney, Agent, or Firm*—Wood, Dalton, Phillips, Mason & Rowe

[57] ABSTRACT

A suction regulator for a compressor, in particular a screw compressor with oil injection, having an element which opens and closes the suction inlet to the compressor. The element closes the inlet due to the bias of a spring, opens the inlet against the bias of the spring in response to compressor discharge pressure and is positioned to regulate the suction in response to the system line pressure.

5 Claims, 1 Drawing Figure

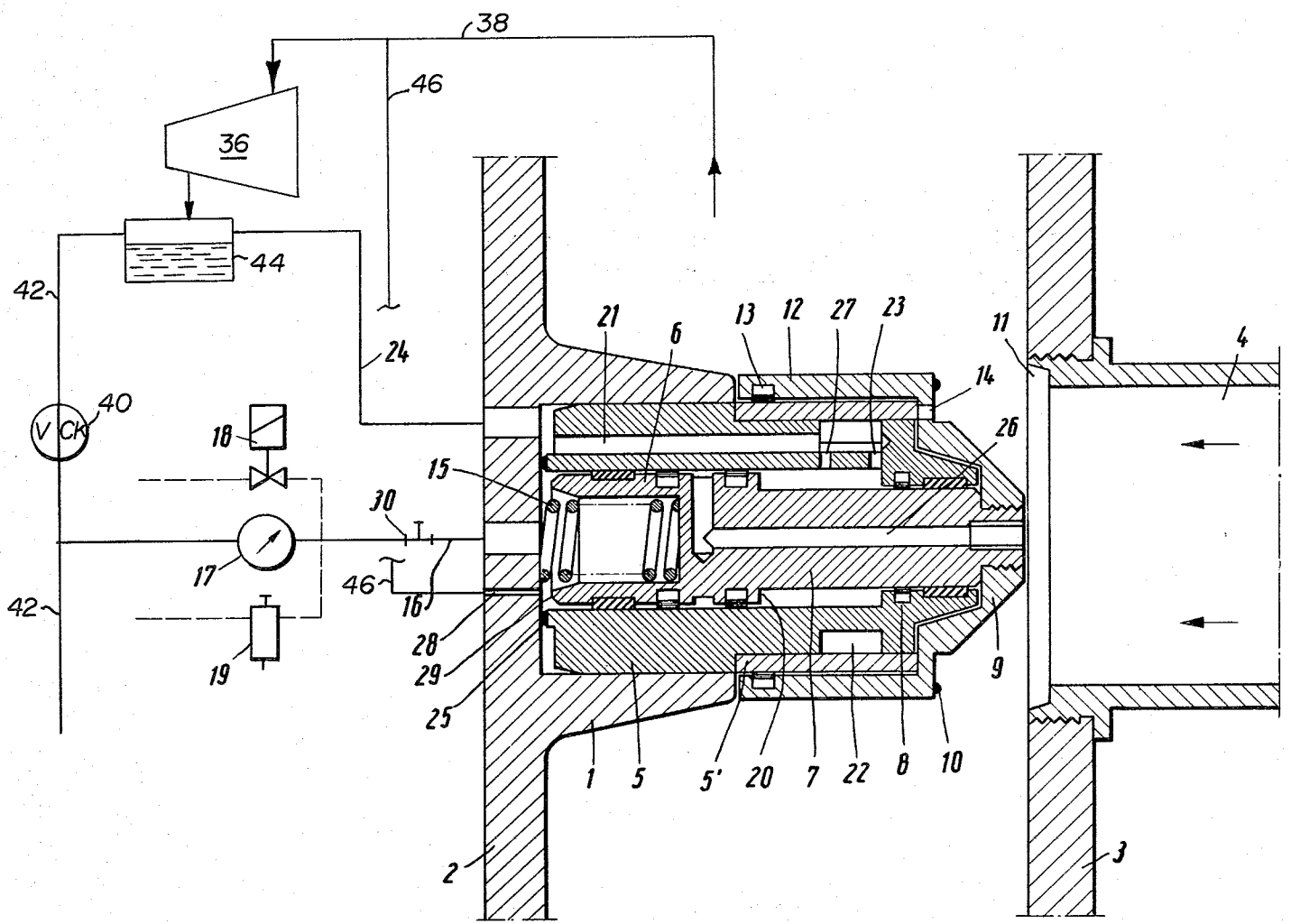
4
3
11
26
14
9
10
23
8
27
22
12
7
13
20
5'
6
5
21
1
38
15
16
28
29
25
2
46
24
30
46
36
44
18
17
19
40
VCR
42
42

COMPRESSOR SUCTION REGULATOR

The invention relates to a suction regulator device for a compressor, in particular a screw compressor with oil injection. A screw compressor having oil injection is the subject of the applicant's commmonly owned copending application Ser. No. 189,815 entitled "Compressor Unit", filed Sept. 23, 1980 the disclosure of which is hereby incorporated by reference. The suction regulator device has an element which opens and closes the suction duct, the element being subjected to the action of a spring and being connected to a control piston which is guided in a cylinder and which can be subjected to pressure medium in the direction of closing.

Such a suction regulator device is known from the German Gebrauchsmuster No. 78 11860, in which the element, which closes the suction duct, is pressed to the opened position by means of a compression spring. By means of the control piston, the suction duct can be shut, against the spring force, when, on reaching the switching-off pressure, compressed air is applied to the piston from, for example, a pneumatic tripout regulator. In the case of a compressor, in particular a screw compressor with oil injection, a suction regulator device of this type can undertake only limited control functions.

The object underlying the invention is to design a suction regulator device, of the type initially described, in such a way that it can carry out several control functions in a reliable manner, while being of simple construction.

This object is achieved, according to the invention, by subjecting the element which closes the suction duct or the control piston to the action of the spring in the direction of closing, and by making it possible to apply the pressure generated by the compressor (operating pressure) to the control piston in the direction of opening.

The spring force can be overcome and the suction duct opened by the pressure generated as the compressor starts up. To close the suction duct, a control pressure, for example the supply system pressure, can be applied to the control piston in the direction of the spring force, so that the operating pressure acting on the opposite end of the piston is overcome. A special check valve can thus be omitted, such a valve normally being provided in the case of a screw compressor with oil injection in order to prevent oil from the oil reservoir escaping through the compressor into the suction duct when the compressor is switched off, due to the fact that the operating pressure still prevails in the oil reservoir on switching-off.

A proportional control system, in which the movement of the element which closes the suction duct is infinitely variable as a function of the compressed air demand can be obtained by making it possible to apply the pressure present on the consumer side (supply system pressure) to the control piston in the direction of closing.

In order to obtain, on the one hand, a delay in the opening of the suction duct when the compressor is switched on and, on the other hand, to achieve sensitive movement of the element which closes the suction duct during proportional control, the pressure area of the control piston, to which area the operating pressure of the compressor is applied, is designed in such a manner, in relation to the spring force, that the spring force can be overcome at a very low operating pressure.

A delay in the opening of the suction duct on switching the compressor on is accomplished by forming a bore, having a small cross-section, in the cylinder on the supply system pressure side of the control piston, this bore communicating with the suction side of the compressor.

To control the flow of air into the compressor suction an electric and/or a pneumatic pressure regulating device is located in the line carrying the supply system pressure to the control piston. The pressure regulating device provides a means whereby the suction regulator device can be electrically and/or pneumatically controlled by applying a control pressure to the supply system pressure side of the control piston.

For venting air from the oil reservoir, in the case of a screw compressor with oil injection, the element which closes the suction duct can be provided with a bore which, when the element is in the closed position, can be connected to the operating pressure side of the control piston or to the line carrying the operating pressure.

In the following text, an illustrative embodiment according to the invention is explained in greater detail with the aid of the drawing, which shows a suction regulator device in a section view.

DESCRIPTION

The suction regulator device shown in the solitary drawing is of cylindrical shape overall and is set into a boss 1 on a housing wall 2 of a compressor 36. Opposite this housing wall 2, a further housing wall 3 is located, in which a suction duct 4 is secured, coaxial to the suction regulator device and to the boss 1. This suction duct 4 can be surrounded by an air-filter cartridge, which is not illustrated. The space between the housing walls 2 and 3 communicates directly with the suction opening of the compressor 36 as schematically represented by line 38.

A cyclinder body 5 is secured in the boss 1, by being pressed-in, for example. A control piston 6 is located, in a manner allowing sliding movement, in the cylinder body 5, the piston shaft 7 of the former extending through the end wall 8 of the cylinder body and carrying a closure element 9 at its free end. The closure element 9, which is designed in the shape of a truncated cone over its leading portion, is fitted with a sealing ring 10, on an annular surface located normal to the longitudinal axis, the sealing ring 10 bearing in a leaktight manner on the seating surface 11 of the suction duct 4 when the closure element 9 is in the closed position.

The closure element 9, which is of approximately pot-shaped design overall, possesses a portion 12 in the form of a cylindrical shell, the longitudinal dimension of which being designed to be somewhat larger than the length of the stroke of the control piston 6. The closure element 9 is guided, by means of this portion 12 in the form of a cylindrical shell, on the external periphery of the cylinder body 5. A seal is located in a first annular groove 13 at the end of the portion in the form of a cylindrical shell, the seal sliding on the peripheral surface of the cylinder body 5. A ventilation opening in the closure element 9 is formed at 14. The ventilation opening 14 provides a connection between the suction duct 4 and the cavity which exists between the closure element 9 and the cylinder body 5 when the former is in the closed position. This development virtually eliminates forces which can occur on the closure element 9, during its stroke movement, as a result of different pressures on the two sides of the closure element 9. The ventilation opening 14 is designed to produce pressure-equalization between the two sides of the closure element 9.

The control piston 6 is subjected to the action of a compression spring 15 in the direction of closing. The spring 15 is supported against the housing wall 2 and is located in a recess of the control piston 6. In addition to the action of spring 15, the control piston 6 can be subjected to the pressure of the supply system. The supply system pressure is supplied by the compressor 36, via a first conduit 16, which protrudes through the housing wall 2 and is coaxial to the longitudinal axis of the compression spring 15. The pressure in the first conduit 16 is taken from the compressor 36 downstream of a check valve 40 located in a pressure line 42 or downstream of a pressure-holding valve. A proportional regulator 17, known to those skilled in the art, is located in the first conduit 16 to control the pressure in the first conduit 16 in proportion to the pressure of the compressed air system.

As indicated by broken lines, a solonoid valve 18 and/or a pneumatic valve 19 may also be connected to the first conduit 16, whereby a control pressure can be applied to the control piston 6 either pneumatically or electrically to close the suction duct 4.

The pressure, generated directly by the compressor 36, is applied, in the direction of the opening, to the control piston 6, on an annular piston area 20. A first bore 21 passes through the cylinder body 5 parallel to the piston axis. The first bore 21 opens into a second annular groove 22, from which a radial second bore 23 opens into the cylinder space. The second annular groove 22 is covered, in a leak-tight manner, by a bushing 5', which forms the guide surface for the closure element 9 on its outer periphery. The longitudinal first bore 21 communicates with a second conduit 24, which extends through the housing wall 2 and is connected to the pressure side of the compressor 36 or, for example, to the oil reservoir 44, and thus leads the pressure directly generated by the compressor 36 to the annular piston area 20 of the control piston 6.

The strength of the compression spring 15 is designed in such a manner, in relation to the aforementioned pressure area 20 on the control piston 6, that a low operating pressure of the compressor 36 is sufficient to displace the control piston 6 against the force of the compression spring 15. The compression spring 15 is preferably designed such that the spring force corresponds approximately to a pressure of one bar on the pressure area 20 of the control piston.

The cylinder body 5, which is of approximately pot-shaped design overall, possesses an annular shoulder 25 on the open end, on which shoulder a sealing ring is attached. The sealing ring separates, in a leak-tight manner, the cylinder space which is pressurized by the first conduit 16, from the pressure imposed by the second conduit 24 to the first bore 21.

An axial third bore 26, having a radial section, passes through the control piston 6 and its shaft 7. When the closure element 9 is in the closed position, the third bore 26 communicates with a radial fourth bore 27, formed in the cylinder body 5, so that the pressure side of the compressor 36 is in communication with the atmosphere, via the third and fourth bores 26, 27 and the suction duct 4, whereby the oil reservoir 44 is vented when the compressor 36 is switched off or when the suction regulator device is closed.

In addition, a fifth bore 28, having a small cross-section, is formed in the housing wall 2. The fifth bore 28 connects the cylinder space, which is pressurized by the first conduit 16, to the suction side of the compressor 36 as schematically shown by line 46 and provides a means whereby the cylinder 5 may be vented when the control piston 6 moves toward a suction opening position. Furthermore the fifth bore 28 provides a means to impose the suction pressure upon the control piston 6. The fifth bore 28 can emerge, for example, in the space between the housing walls 2 and 3.

The pressure chamber 29 on the control piston 6, which is pressurized by the first conduit 16, can, for example, be designed so that it is twice as large as the opposite pressure area 20. However, depending upon the design of the compression spring 15, other ratios between the annular piston area 20 and the pressure chamber 29 can be provided. The pressure chamber 29, which acts in conjunction with the spring 15 in the direction of closing, is larger than the annular piston area 20 so that pressures less than that acting upon the annular piston area 20 are able to move the control piston 6 and closure element 9 toward a closed position.

The compression spring 15 is designed such that it just holds the control piston 6 in the closed position when the suction of the suction side is present at the pressure area 29 as imposed by the fifth bore 28. If the pressure on the pressure area 20 arises, then the control piston 6 is pushed toward an open position.

The suction regulator device can be controlled from three different points (proportional regulator 17, solenoid valve 18 and pneumatic valve 19), thus allowing proportional control and open-shut control from electric controls or from pneumatic controls.

The suction regulator device functions as follows. When the compressor 36 is switched off, the closure element 9 closes the suction duct 4 under the force of the spring 15. The first conduit 16 is connected to the atmosphere, via one of the valves 18 or 19. The pressure side of the compressor 36, or the oil reservoir 44, is also connected to the atmosphere, via the second conduit 24 and the first, fourth and third bores 21, 27, 26.

When the compressor is switched on, a certain pressure is built up which acts on the pressure area 20 of the control piston 6. At the same time a certain suction is built up, via the fifth bore 28 which communicates with the suction side, such that, after the compressor 36 starts up, the control piston 6 is displaced somewhat towards the left as viewed in the drawing. Concurrently, the connection between the third and fourth bores 26, 27 is interrupted and the venting of the pressure side is thereby terminated. The control piston 6 can be pushed into the completely open position, as illustrated, at an operating pressure of approximately 1 bar.

In regulated operation, with infinitely variable setting of the suction regulator device, the first conduit 16 is connected to the supply system pressure line 42, via the proportional regulator 17. Since the area of the pressure chamber 29 of the control piston 6 is larger than the annular piston area 20, which is subjected to the operating pressure, the suction regulator device remains open as long as a pressure smaller than the operating pressure minus the spring force prevails downstream of the proportional regulator 17. When this pressure downstream of the proportional regulator 17 approaches the operating pressure minus the spring force, the control piston 6 begins to move to the right. In the illustrative embodiment described, the suction regulator device begins to close the suction duct 4, when for a final pressure of 7 bar, the supply system pressure reaches 6 bar. In regulated operation, the suction regulator device opens automatically, in a corresponding manner, when the supply system pressure falls.

In another mode of operation of the compressor 36, the first conduit 16 can be connected to the atmosphere, via one of the valves 18, 19, so that the suction regulator device is in the fully open position, as illustrated, during the operation of the compressor. In dependence on an electrical or pneumatic control system, a control pressure for the immediate closing of the suction duct 4 can be imparted to the pressure chamber 29, via one of the valves 18, 19. The supply system pressure is therefore, advantageously employed as a control pressure. In the case of such continuous operation, the suction duct 4 is merely opened and closed, without the closure element 9 taking up intermediate positions as in the case of regulated operation.

An isolating valve in the first conduit 16 is marked 30.

Various modification of the construction designed are possible. Thus, the venting third bore 26 in the control piston 6 can be omitted, or an exchangeable restrictor can be inserted into the leading part of the closure element 9.

While I have shown and described certain embodiments of this invention, it is to be understood that it is capable of many modification. Changes, therefore, in the construction and arrangement may be made without departing from the spirit and the scope of the invention as disclosed in the attached claims.

I claim:

1. In an oil injection screw compressor having a suction duct, an outlet and an oil reservoir connected with the outlet and pressurized by the compressor discharge, a suction regulator comprising:

a cylinder having a closed end and an open end directed toward said compressor suction duct;

a piston slidably disposed in said cylinder for movement between a retracted open position spaced from said compressor suction duct to an extended position, said piston having a closure element adapted to seat in and close said suction duct in the extended position of the piston;

biasing means interposed between said piston and cylinder to urge said piston toward the extended position;

means for retracting said piston and closure element to open said suction duct when said compressor is operating; and means to vent the air pressure in said oil reservoir through said piston and cylinder into said suction duct when said suction duct is closed to prevent oil in said reservoir from being forced through said compressor into said suction duct.

2. The suction regulator of claim 1 wherein said venting means includes a conduit extending from said reservoir to said cylinder, said cylinder includes a bore extending therealong to provide communication between said conduit and said piston and said piston includes a bore extending therethrough and through the closure element to provide communication between said cylinder bore and the suction duct for venting said reservoir.

3. In an oil injected screw compressor having a suction duct, an outlet and an oil reservoir connected with the outlet and pressurized by the compressor discharge, a suction regulator comprising:

a cylinder having a closed end and an open end directed toward said suction duct, a first bore extending axially along the wall of said cylinder from said closed end toward said open end and a second bore extending radially inward from the terminus of said first bore;

a piston slidably disposed within said cylinder for movement between a retracted open position spaced from said compressor suction duct and an extended position, a portion of said piston having a reduced cross-section to define an annular area directed toward said suction duct;

a closure element secured to said piston, said closure element being adapted to close said suction duct when said piston is extended from said cylinder;

a spring interposed between said cylinder closed end and said piston to urge the extension of said piston from said cylinder and the closure of said suction duct by said closure element;

a first conduit extending from the compressor discharge to the closed end of said cylinder to control extension of said piston from said cylinder for positioning said closure element; and a second conduit extending from the oil reservoir to said cylinder first bore to introduce the pressure of the oil reservoir through said cylinder first and second bores against said annular area of said piston to retract said piston and closure element from said suction duct against the bias of said spring.

4. The suction regulator of claim 3 wherein said cylinder second bore is closed when said piston is extended for closure of the suction duct and said suction regulator further includes a bore extending into the closed end of said cylinder from said compressor to introduce a suction into said cylinder to retract said piston and closure element from the suction duct to a position where said second bore communicates with said annular area when said compressor is started.

5. The suction regulator of claim 3 wherein said cylinder has an additional bore extending from said first bore and said piston and closure element have a common bore extending therethrough to vent the pressure in said oil reservoir through the second conduit, first bore, additional bore and said piston bore into said suction duct when the compressor is not operating and said piston is extended, and said suction duct is closed to prevent oil in the reservoir from flowing through the compressor into said suction duct.

* * * * *